United States Patent [19]

Sheu

[11] Patent Number: 4,515,280

[45] Date of Patent: May 7, 1985

[54] COUPLING DEVICE

[76] Inventor: Roung-Hwang Sheu, No. 18, Lane 191, Sec. 1, Nan-Ko Rd., Changhua City, Taiwan

[21] Appl. No.: 615,904

[22] Filed: May 31, 1984

[51] Int. Cl.[3] ..... F16B 5/06

[52] U.S. Cl. ..... 211/189; 52/285; 108/111; 211/186; 211/41; 403/170; 312/140

[58] Field of Search ..... 211/189, 41, 186, 155, 211/194, 190; 403/170, 171, 176; 46/31; 108/111, 114; 312/140; 52/285, 582

[56] References Cited

U.S. PATENT DOCUMENTS

| | | | |
|---|---|---|---|
| 3,715,136 | 2/1973 | Yoshida | 52/285 |
| 3,874,133 | 4/1975 | Silvios | 52/285 |
| 3,913,289 | 10/1975 | Recker | 312/140 X |
| 3,985,083 | 10/1976 | Pofferi | 211/186 X |
| 4,124,958 | 11/1978 | Chiche | 52/285 |

*Primary Examiner*—Robert W. Gibson, Jr.

*Attorney, Agent, or Firm*—Cushman, Darby and Cushman

[57] ABSTRACT

The coupling device for securing adjacent boards to construct a display case is molded from a plastic material and made in such a way, that a pair of plate members are spaced from each other to define a groove for receiving a corner of the board therein. The pair of plate members are connected by a pair of triangular prismatic portions extending on two adjacent sides thereof and with the two adjacent sides formed into a right angle, the groove is positioned opposite to the two adjacent sides. Along the longitudinal direction of the triangular prismatic portion a slot or a rod is alternatively provided, and a connecting member is provided with at least two complementary parts thereon for mating with the rods or the slots of at least two other triangular prismatic portions of two adjacent coupling devices, so as to connect the same.

1 Claim, 10 Drawing Figures

COUPLING DEVICE

BACKGROUND OF THE INVENTION

This invention relates to a coupling device and particularly concerns a coupling device which can be assembled with several units thereof and having each unit holding a plate to form a display case having a plurality of compartments for show articles placed therein.

The display cases are usually used to show the public articles to be sold, it is desired that the compartments of each case can be varied with respect to the number or size thereof in accordance with the situation of use. Therefore, the collapsible display case has been suggested. An assembly case is already known comprising a metal skeleton having vertical and horizontal members to form frames over which the plates can be placed to provide the supporting surface for the articles. However, the assembling of skeleton from vertical and horizontal members is usually by means of the threaded portions on corresponding parts of the members, so that, the threading requires extra labor which accounts for additional cost.

The prior-art arrangement is further disadvantageous because of the difficulty in collapsing and assembling, inherent in the construction thereof.

SUMMARY OF THE INVENTION

It is accordingly the general object of the invention to overcome the shortcomings existing in the prior art.

It is a more particular object to provide an novel coupling device used to couple several boards at right angles with respect to each other; thus to form a case having a plurality of compartments.

It is another object of this invention to provide a coupling device with the above purpose in view, which also can be manufactured at a low cost.

In accordance with these objects, in a display case of the type having a plurality of rectangular boards coupled to one another to form compartments, a device for coupling boards comprising: a flat member having two adjacent first sides forming a right angle therebetween, a second side opposite to the right angle having a groove for receiving one corner of the board, two projecting portions extending outwards respectively from said first sides, each of said projecting portions having isosceles right-angled triangle shaped cross-section with a hypotenuse contiguous to said first side; and means for connecting each said projecting portion to the projecting portion of another coupling device when said projecting portions are in side by side adjacent relationship.

The invention itself, both as to its construction and its use, together with additional objects and advantages thereof, will be best understood from the following description of specific embodiments when read in connection with the accompanying drawings.

BRIEF DESCRIPTION OF THE DRAWINGS

It should be noted that the like parts are designated as the same numerals throughout the description.

DETAILED DESCRIPTION OF THE PREFERRED EMBODIMENT

Figure 2:
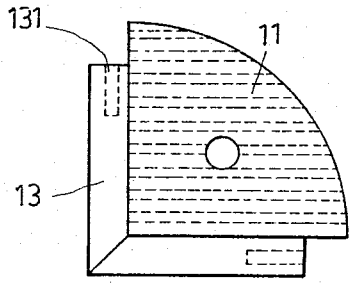
FIG. 2 is a top view of a coupling device as shown in FIG. 1.
Figure 3:
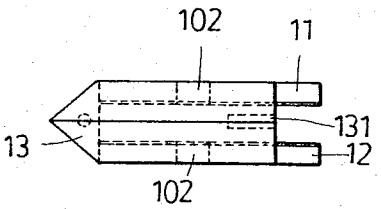
FIG. 3 is a side view of a coupling device as shown in FIG. 2.

Referring now to the drawings, a coupling device 1 includes an upper plate 11 and a lower plate 12 both made into a shape of a sector, both plates are connected to each other by a pair of triangular prismatic portions 13 attached to the two adjacent sides thereof. The two adjacent sides has a right angle therebetween, so that, between the upper plate 11 and lower plate 12 a right angled groove 23 is defined, which can receive a corner of the rectangular board.

Figure 1:
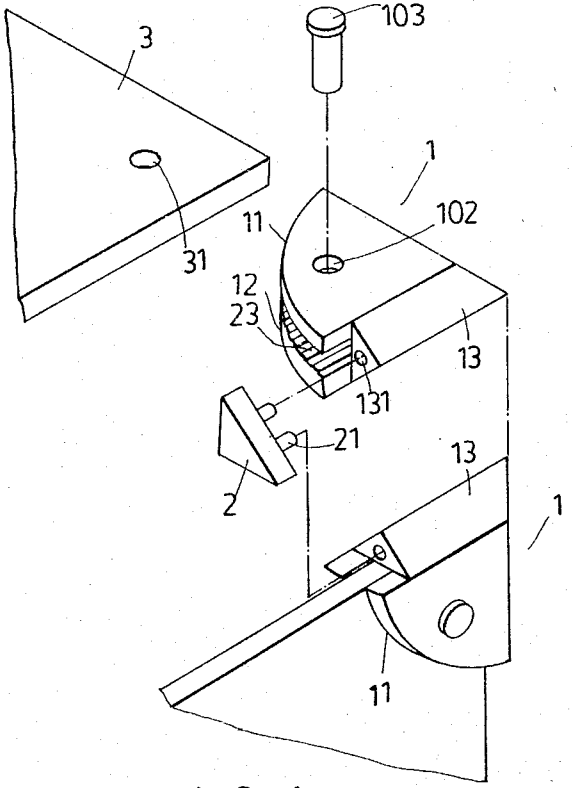
FIG. 1 is a schematic view showing the coupling device and the use thereof according to a preferred embodiment of this invention.

FIG. 1 shows two coupling devices 1, 1 to be coupled such that the pair of plates 11, 12 of the verticle coupling device is perpendicular to that of the horizontal one, the boards secured thereby are also perpendicular with respect to each other.

The triangular prismatic portion 13 is formed with an isosceles right-angled triangular cross-section, the surface corresponding to the hypoteneous of the isosceles right-angled triangle, namely opposite to the right angle, is contiguous to the two sides that define a right angle. The prismatic portions 13, 13 are offsetted from the plates 11, 12 at one end and, the other ends thereof are extended to meet at an edge.

In this embodiment, a slot 131 is provided on the the triangular prismatic portion 13, extending through a distance suitable for accepting a rod 21 of the connecting member 2 which will be described later on.

According to this invention, the upper plate 11 and lower plate 12 define a pair of confronting surfaces thereof as the clamping surfaces of a rectangular board 3 secured therebetween, in order to improve the effect of clamping, the confronting surfaces can be formed with parallel arranged ridges, thereby the board 3 can be frictionally fitted therein.

In the preferred embodiments, the upper plate 11 is provided with hole 102, the board 3 to be secured with a hole 31 made on the corner, by such arrangement, when a board having one corner insert to the groove 101 and with its hole 31 in line with the hole 102 of the upper plate 11, the two members can be further secured by inserting a pin 103 through the holes 102, 31 thereof.

The shape of plates 11, 12 are not restricted to this sector, referring to FIGS. 4, 8, 9 and 10, in other embodiments, the triangular, square or L-shaped plates can also be put to a similar use, the requirement is that a right angle must be included, so that it can adapt to the angle of the rectangular board. It is also noted in FIG. 9 that in the case of a L-shaped plates are adopted, two holes 101, 102 can be provided on the two normal sections.

The connecting of units of the coupling device 1 can be effected by various types of means, as shown in FIG. 1, the two units are assembled to form a corner, in such situation, the connecting means being used is a triangular member 2 including two rods 21 adapted to be inserted into the corresponding slots 131 of each of the two adjacent coupling devices 1, 1.

Figure 4:
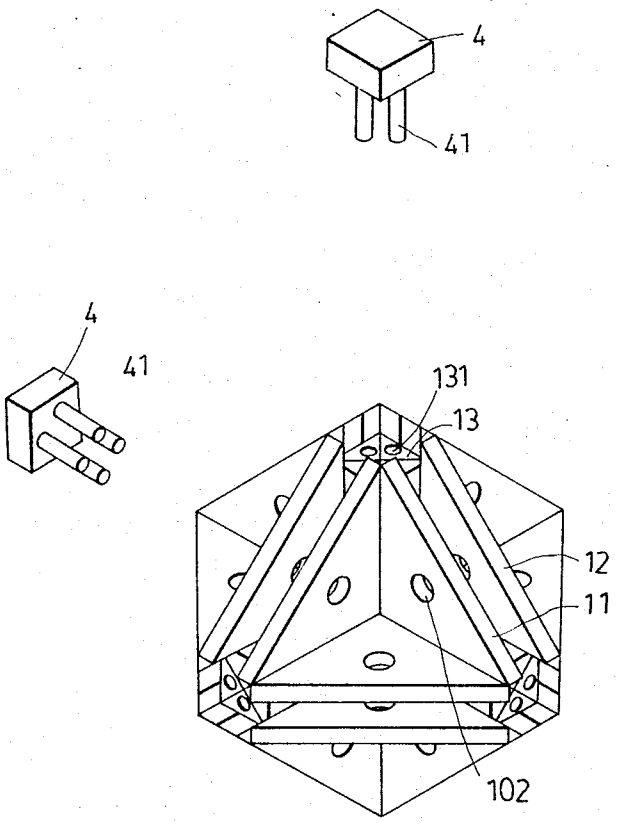
FIG. 4 is a perspective view schematically showing twelve coupling devices in assembled state, with two connectors shown separately.
Figure 5:
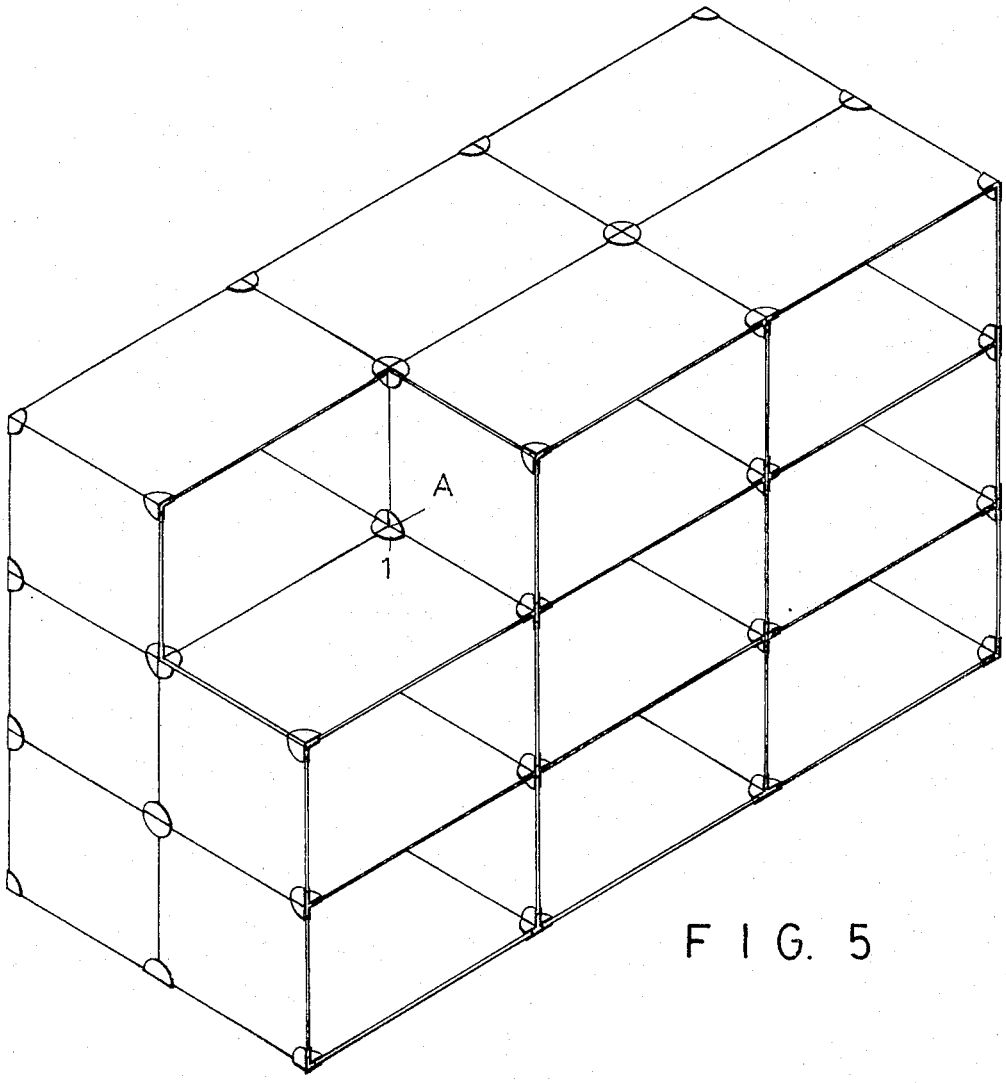
FIG. 5 is a perspective view of a display case having vertical and horizontal boards connected with each other by means of the coupling device according to this invention.

If it is the case that several compartments arranged in the width, depth and height directions should be constructed by the boards coupled with one another, the coupling device securing the boards positioned around a point such as a point A in FIG. 5 are connected by a connecting means as shown in FIG. 4, which includes a square member 4 having four rods 41 insertable into the slots 131 on four adjacent coupling devices.

There are at most eleven positions of a coupling device 1 for coupling with another coupling device 1, as best seen in FIG. 4 and FIG. 5, each unit device is in abutment with the adjacent units on the inclined surface of the triangular prismatic portion 13. In FIG. 4, by reference, the three sides of a coupling device are designated as X, Y, Z axes according to their relative directions respectively, for example, the coupling device having two plates is positioned on a plane referred as X, Y plane, then, the eleven neighbor positions are corresponding to the (X, −Y), (−X, Y), (−X, −Y), (Y, Z), (Y, −Z), (−Y, Z), (−Y, −Z), (X, Z), (X, −Z), (−X, Z), (−X, −Z) planes. As can be understood from FIG. 4, when twelve units of the coupling device are coupled about a point A, it is needed three square connecting means 2 as suggested hereinbefore to complete the connection therebetween.

Figure 7:
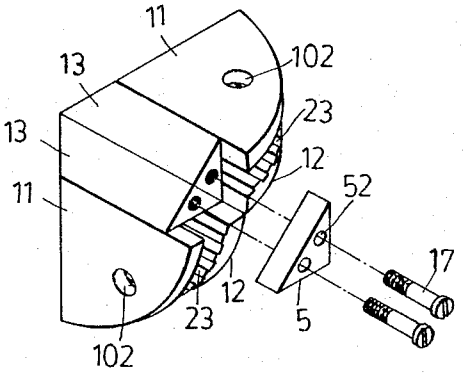
FIG. 7 is a schematic view showing the connection of two adjoining coupling device by use of a connecting member according to another design different from that as shown in FIG. 1 and FIG. 6.
Figure 10:
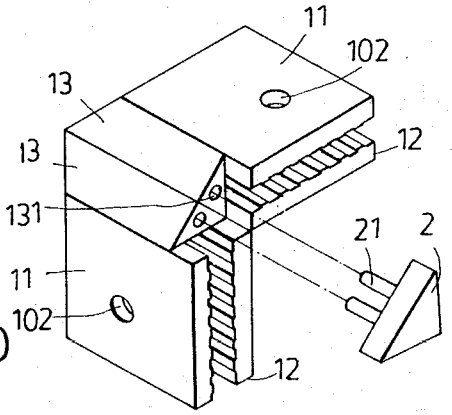
FIG. 10 is a schematic view of a still further embodiment of the coupling device according to this invention.
Figure 8:
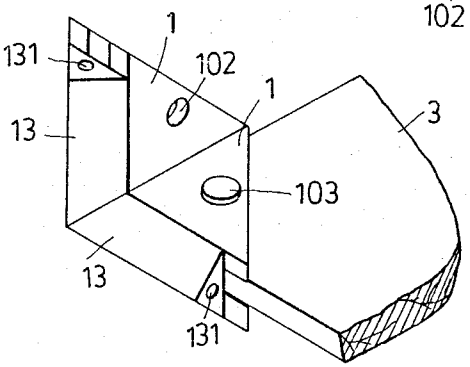
FIG. 8 is a schematic view of another embodiment of the coupling device according to this invention.
Figure 6:
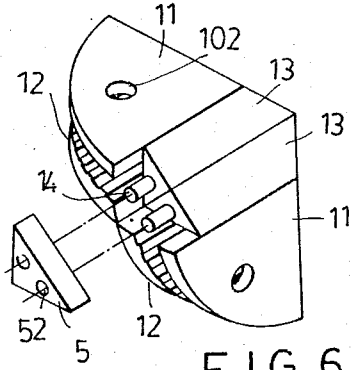
FIG. 6 is a schematical view showing the connection of two adjoining coupling device by use of a connecting member different from that as shown in FIG. 1.
Figure 9:
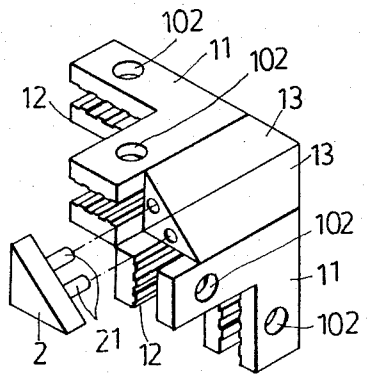
FIG. 9 is a schematic view of a further embodiment of the coupling device according to this invention.

The rod and hole of the connecting means can be exchanged in position, as shown in FIG. 6, a pair of rods 14 are provided on the offset end, a triangular member 5 is corresponding provided with hole 52 to receive the rod 14. Alternatively, in the embodiment shown in FIG. 7, a pair of screws 17 can be substituted for the pair of rods 14, the holes 52 and slot 131 are threaded to engage with the screws 17.

Moreover, the embodiments of the improved construction illustrated and described herein are by way of example, and the scope of the invention is not limited to the exact details of construction.

Having now described the invention, the new and useful coupling device and structural equivalents thereof obvious to those skilled in the art, are set forth in the appended claims.

I claim:

1. In a display case of the type having a plurality of rectangular boards coupled to one another to define compartments, a device for coupling boards comprising:

a flat member having two adjacent first sides forming a right angle, a second side opposite to the right angle having a groove for receiving one corner of the board, two projecting portions extending outwards from said first sides respectively, each of said projecting portions having isosceles right-angled triangle shaped cross-section with a hypotenuse contiguous to said first side; and means for connecting each said projecting portion to the projecting portion of another coupling device when said projecting portions are in side by side adjacent relationship.

* * * * *